US008198498B2

(12) United States Patent
Keyvanloo et al.

(10) Patent No.: US 8,198,498 B2
(45) Date of Patent: Jun. 12, 2012

(54) CARBON NANOTUBE CATALYST FOR OLEFIN PRODUCTION

(76) Inventors: Kamyar Keyvanloo, Mashhad (IR); Jafar Towfighi Darian, Tehran (IR); Ali Mohamadalizadeh, Tehran (IR)

( * ) Notice: Subject to any disclaimer, the term of this patent is extended or adjusted under 35 U.S.C. 154(b) by 174 days.

(21) Appl. No.: 12/859,295

(22) Filed: Aug. 19, 2010

(65) Prior Publication Data

US 2010/0317909 A1 Dec. 16, 2010

(51) Int. Cl.
*C07C 4/04* (2006.01)

(52) U.S. Cl. ..... 585/651; 585/648; 585/650; 585/652; 585/653

(58) Field of Classification Search ..... None
See application file for complete search history.

(56) References Cited

U.S. PATENT DOCUMENTS

| | | | | |
|---|---|---|---|---|
| 6,875,417 | B1 * | 4/2005 | Shah et al. | 423/650 |
| 7,563,428 | B2 * | 7/2009 | Resasco et al. | 423/447.3 |
| 2007/0116630 | A1 * | 5/2007 | Resasco et al. | 423/447.3 |
| 2008/0316711 | A1 * | 12/2008 | Dimitrakopoulos et al. | 361/718 |

* cited by examiner

*Primary Examiner* — Tam M Nguyen
(74) *Attorney, Agent, or Firm* — International IP Group, LLC

(57) ABSTRACT

A method for producing olefins using a carbon nanotube catalyst is disclosed. Initially, a hydrocarbon feedstock is received. The hydrocarbon feedstock, the carbon nanotube catalyst, and steam are mixed in a thermal cracking reactor. The mixture is heated in the thermal cracking reactor to a particular temperature. The olefins are then separated from the mixture. The carbon nanotube catalyst can include carbon nanotubes coated with $M1_xO_y$ and modified with $M2_mO_n$. M1 can be either the element silicon or tungsten, x can be an integer that represents the oxidation number of M1, and y can an integer that represents the number of oxygen atoms required by the oxidation number of M1. M2 can be a metallic element, m can be an integer that represents the oxidation number of M2, and n can be an integer that represents the number of oxygen atoms required by the oxidation number of M2.

20 Claims, 4 Drawing Sheets

CARBON NANOTUBE CATALYST FOR OLEFIN PRODUCTION

SPONSORSHIP STATEMENT

This application has been sponsored by the Iranian Nanotechnology Initiative Council and the Tarbiat Modares University, which do not have any rights in this application.

TECHNICAL FIELD

This application generally relates to olefin production, and more particularly relates to olefin production using a carbon nanotube catalyst.

BACKGROUND

Known catalysts used in the production of olefins suffer from several disadvantages. For example, solid catalysts suffer from relatively slow heat and/or mass transfer. As such, the speed and efficiency of a chemical reaction for the production of olefins is limited by the relatively long time necessary for heat penetration into or escape from the catalyst and by the relatively long time necessary for various molecules to physically interact with the solid catalyst.

The reactivity of the zeolite-based catalysts in high temperature and high humidity environments is low due to the generation of coke during the cracking process and the dealumination of the zeolite-based catalysts. Therefore, hydrocarbon cracking using zeolite-based catalysts requires use of circulating fluidized bed reactors to reduce the deactivation of the zeolite-based catalysts.

Typically, steam cracking processes operate at high temperatures of over 830° C. and increase the deposition of coke on the surface of a reaction tube, which interferes with heat transfer. To compensate for the heat transfer interference, the temperature of the reaction tube is increased, which further increases energy consumption.

SUMMARY

A method for producing olefins using a carbon nanotube catalyst is disclosed. Initially, a hydrocarbon feedstock is received. The hydrocarbon feedstock, the carbon nanotube catalyst, and steam are mixed in a thermal cracking reactor. The mixture is heated in the thermal cracking reactor to a particular temperature. The olefins are then separated from the mixture. The carbon nanotube catalyst can include carbon nanotubes coated with $M1_xO_y$ and modified with $M2_mO_n$. M1 can be either the element silicon or tungsten, x can be an integer that represents the oxidation number of M1, and y can an integer that represents the number of oxygen atoms required by the oxidation number of M1. M2 can be a metallic element, m can be an integer that represents the oxidation number of M2, and n can be an integer that represents the number of oxygen atoms required by the oxidation number of M2.

In some embodiments, the metallic element M2 can be an element selected from the group including calcium, strontium, magnesium, barium, iron, nickel, cobalt, manganese, molybdenum, copper, chromium, gallium, bismuth, aluminum, lanthanum, cerium, and tin. The carbon nanotube catalyst can include 65% to 95.5%, by weight, carbon nanotubes, 3% to 20%, by weight, $M1_xO_y$, and 1.5% to 15%, by weight, $M2_mO_n$. In some embodiments, $M1_xO_y$ can be $SiO_2$ and $M2_mO_n$ can be $CeO_2$. The carbon nanotube catalyst can include 10% $CeO_2$ by weight and 10% $SiO_2$ by weight. The carbon nanotubes of the carbon nanotube catalyst can have a length-to-width aspect ratio of equal to or greater than ten.

In some embodiments, the hydrocarbon feedstock can be a petroleum hydrocarbon feedstock, such as, for example, a full-range naphtha including 44.28% n-paraffin, 39.31% isoparaffin, 12.68% naphthene, and 3.73% aromatics.

In some embodiments, water can also be received. The hydrocarbon feedstock can be vaporized in a first vaporizer to produce vaporized hydrocarbon feedstock, the water can be vaporized in a second vaporizer to produce steam, and the vaporized hydrocarbon feedstock and the steam can be mixed.

In some embodiments, the mixture of the hydrocarbon feedstock, the carbon nanotube catalyst, and the steam can be heated in the thermal cracking reactor to a temperature between 600 and 680° C. The mixture of the hydrocarbon feedstock, the carbon nanotube catalyst, and the steam in the thermal cracking reactor can be heated for between 0.5 to 100 seconds. The mixture of the hydrocarbon feedstock, the carbon nanotube catalyst, and the steam can be heated in a fixed-bed reactor. The space velocity of the fixed-bed reactor can be between 0.5 and 40 $hr^{-1}$. In other embodiments, the mixture of the hydrocarbon feedstock, the carbon nanotube catalyst, and the steam can be heated in a fluidized-bed reactor to the particular temperature.

In some embodiments, the range of the weight ratio of the hydrocarbon feedstock to the carbon nanotube catalyst can be between 5:1 and 20:1 in the thermal cracking reactor. The range of the weight ratio of the hydrocarbon feedstock to the steam can be between 0.1:1 to 2:1 in the thermal cracking reactor.

In some embodiments, ethylene and/or propylene can be separated from the mixture of the hydrocarbon feedstock, the carbon nanotube catalyst, and the steam. The total yield of olefins can be at least 44%.

Details of one or more embodiments and/or implementations of the carbon nanotube catalyst for olefin production are set forth in the accompanying drawings and the description below. Other aspects that can be implemented will be apparent from the description and drawings, and from the claims.

DESCRIPTION OF DRAWINGS

Like reference symbols indicate like elements throughout the specification and drawings.

DETAILED DESCRIPTION

The carbon nanotube (hereinafter "CNT") catalyst disclosed in the present application improves the production yield of olefins, i.e., alkenes, such as ethylene and propylene, while reducing the energy required for hydrocarbon cracking due to the lower temperature required during cracking in comparison with prior hydrocarbon cracking methods. Moreover, the CNT catalyst exhibits excellent carbon deposition characteristics and stability by reducing the deposition of coke on the surface of reaction tubes. The high heat conductivity and advantageous morphology, e.g., high length-to-width aspect ratio, of CNTs enable improvements in the production yield of olefins.

Figure 1:
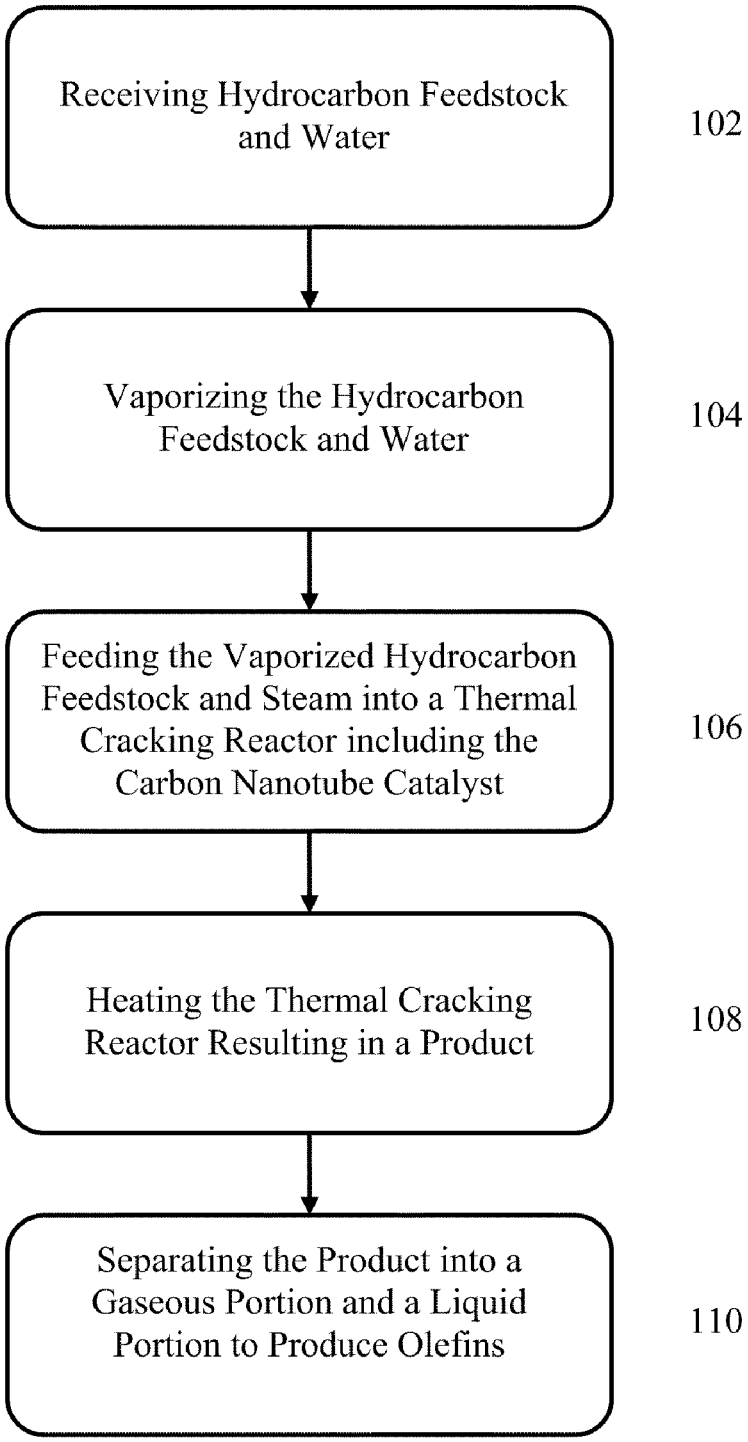
FIG. 1 is a flowchart of an example of a process for olefin production using a carbon nanotube catalyst.
Figure 2:
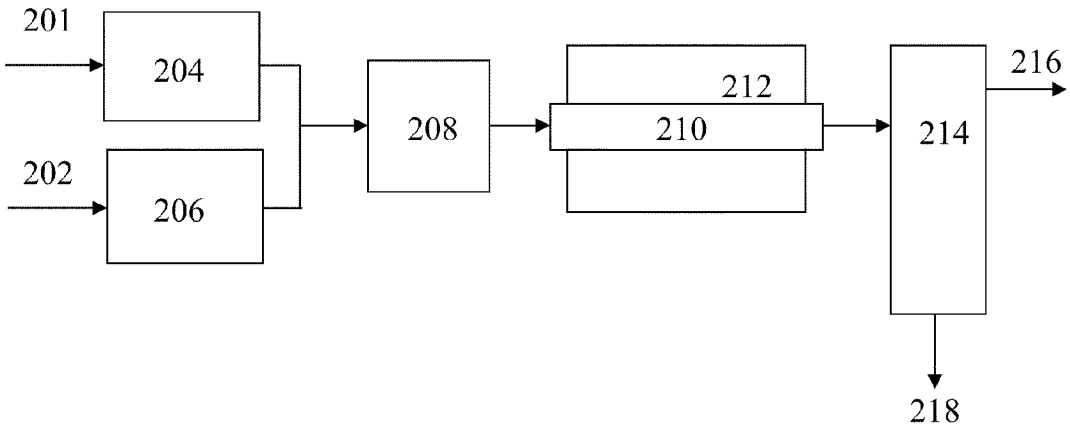
FIG. 2 is a block diagram of an example of a system for producing olefins from hydrocarbon feedstock using a carbon nanotube catalyst.
Figure 3:
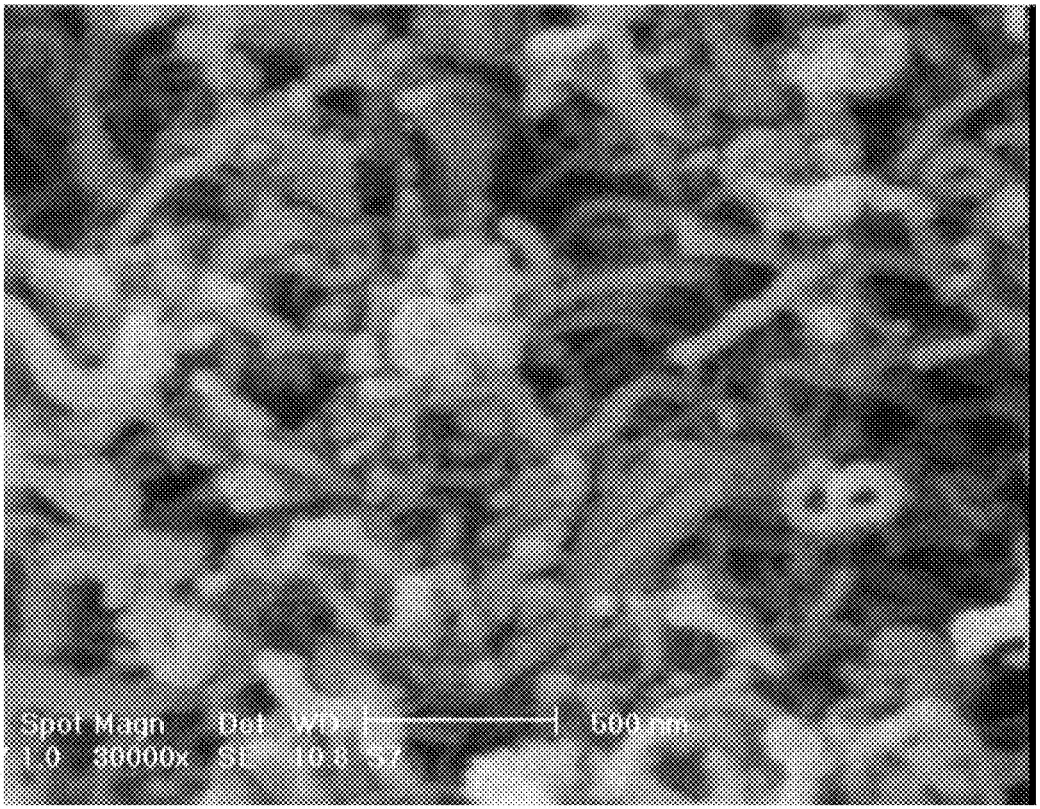
FIG. 3 is a scanning electron microscope image of an example carbon nanotube catalyst.

Referring to FIGS. 1 to 3, the process for olefin production using the CNT catalyst is disclosed. Referring to step 102 of FIG. 1, hydrocarbon feedstock 201 and water 202 are initially received. The hydrocarbon feedstock can be received, for example, in vaporizer 204, and the water can be received, for example, in a separate vaporizer 206, as illustrated in FIG. 2.

In some embodiments, the hydrocarbon feedstock can be any feedstock that contains olefins. In some embodiments, the hydrocarbon feedstock can be, for example, a petroleum hydrocarbon feedstock, such as, for example, light naphtha, full-range naphtha, kerosene, fuel oil, gas oil, and/or $C_{20-30}$ heavy fractions.

The full-range naphtha can contain, for example, n-paraffin, iso-paraffin, naphthene, aromatics, and/or olefin compounds. In some embodiments, the full-range naphtha consists of 44.28% n-paraffin, 39.31% iso-paraffin, 12.68% naphthene, and 3.73% aromatics.

Referring to step 104, the vaporizers 204 and 206 vaporize the hydrocarbon feedstock 201 and water 202, respectively. The vaporized hydrocarbon feedstock and steam can be mixed together in a pre-heater 208, which can also include a turbine. Referring to step 106, the mixture of the vaporized hydrocarbon feedstock and steam can be fed into a thermal cracking reactor 210 that includes the CNT catalyst.

In anhydrous form, the weights of the components of the CNT catalyst can be, for example, 65% to 95.5% CNTs, 3% to 20% $M1_xO_y$, and 1.5% to 15% $M2_mO_n$. "M1" can be, for example, an element that coats the CNTs in order to increase their thermal stability in an oxidative environment. CNTs have been known to form a matrix structure in oxidative environments, which affects their properties. Because oxidizing agents, such as, for example, $O_2$ and/or $CO_2$, are produced during the thermal hydrocarbon cracking process, the CNTs are coated with $M1_xO_y$ so that the CNTs are less likely to form a matrix. Thermogravimetric analysis has shown that the oxidation of CNTs coated with $M1_xO_y$ occurs at a temperature almost 100° C. higher than that of uncoated CNTs.

In some embodiments, "M1" can be, for example, silicon (Si) or tungsten (W). The oxidation number of "M1" is represented by "m." The number of oxygen (O) atoms required by the oxidation number, i.e., state, of "M1" is represented by "n."

"M2" can be, for example, an element that increases the selectivity of the CNT catalyst to olefins. In some embodiments, "M2" can be, for example, an alkaline earth metal such as calcium (Ca), strontium (Sr), magnesium (Mg), and barium (Ba); a transition metal such as iron (Fe), nickel (Ni), cobalt (Co), manganese (Mn), molybdenum (Mo), copper (Cu), and chromium (Cr); or a heavy metal such as gallium (Ga), bismuth (Bi), aluminum (Al), lanthanum (La), cerium (Ce), and tin (Sn). The oxidation number of "M2" is represented by "x." The number of oxygen (O) atoms required by the oxidation number, i.e., state, of "M2" is represented by "y."

Each of the values for "x," "y," "m," and "n" are integers greater than zero and can vary based on the elements selected as "M1" and "M2." In some embodiments, $M1_xO_y$, can be, for example, $SiO_2$ or $W_2O_3$, while $M2_nO_m$, can be, for example, $Fe_2O_3$, $CeO_2$, or $Ni_2O_3$. Referring to FIG. 3, a scanning electron microscope image of an example CNT catalyst that is coated with $SiO_2$ ($M1_xO_y$) and modified with $CeO_2$ ($M2_mO_m$) is illustrated.

Referring to step 108, the thermal cracking reactor 210 can be placed in a high-temperature furnace 212 or another system for heating the thermal cracking reactor 210 to produce a reaction product. In some embodiments, added steam can reduce the partial pressure of hydrocarbon and coke deposition. The thermal cracking reactor 210 can be heated to between 500 and 700° C. or, preferably, to between 600 and 680° C. In some embodiments, the residence time of the hydrocarbon feedstock, i.e., the average amount of time that the hydrocarbon feedstock spends in the reactor, is between 0.1 and 200 seconds or, preferably, between 0.5 and 100 seconds. In some embodiments, the run time of the system can be a time necessary for the system to stabilize, such as, for example, 5 minutes to 48 hours.

The range of the weight ratio of hydrocarbon feedstock to steam can be between 0.01:1 and 10:1 or, preferably, between 0.1:1 and 2:1. The thermal cracking reactor 210 can be any type of reactor and, preferably, either a fixed-bed reactor or a fluidized-bed reactor. If the thermal cracking reactor 210 is a fixed-bed reactor, the space velocity, i.e., the relation between volumetric flow and reactor volume, can be, for example, between 0.1 and 100 $hr^{-1}$ or, preferably, between 0.5 and 40 $hr^{-1}$. Due to the decoking characteristics of the CNT catalyst, use of a fixed-bed reactor does not require use of a regenerator, thereby saving additional energy. The decoking characteristic of the CNT catalyst is due to its relatively high heat conductivity which prevents the catalyst bed from producing heat spots. If the thermal cracking reactor 210 is a fluidized-bed reactor, the range of the weight ratio of hydrocarbon feedstock to the CNT catalyst can be between 1:1 and 40:1 or, preferably, between 5:1 and 20:1.

Referring to step 110, the reaction product can be fed into a quench tower 214, which acts to cool the reaction product it receives from the thermal cracking reactor 210. The reaction product is separated into a gaseous product 216 including $C_4^-$ hydrocarbons, such as, for example, methane, ethane, propane, ethylene, propylene, and/or n-butane, and a liquid product 218 containing dilution water and $C_5^+$ hydrocarbons, such as, for example, n-pentane, iso-pentane, and/or n-hexane.

Figure 4:
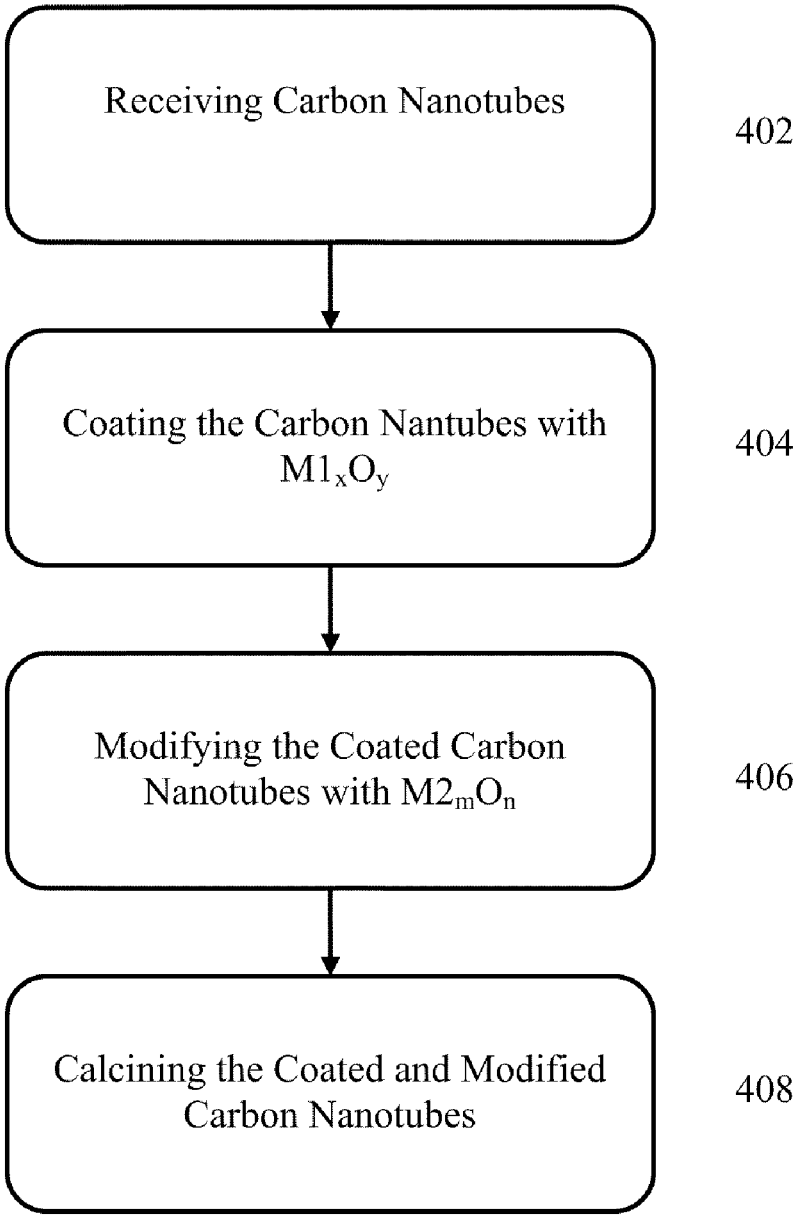
FIG. 4 is a flowchart of an example of a process for synthesizing a carbon nanotube catalyst.

Referring to FIG. 4, the process for synthesizing the CNT catalyst is disclosed. Referring to step 402, CNTs are initially received. Various types of CNTs can be received, such as, for example, single-walled CNTs, double-walled CNTs, and/or multi-walled CNTs. The CNTs have a cylindrical form with a diameter of, for example, less than or equal to 200 nm. In some embodiments, the diameter of the CNTs can, preferably, be between 10 and 80 nm. The length of the CNTs can be at least 1 μm or, preferably, between 5 and 200 μm. The length-to-width aspect ratio of the CNTs is at least three or, preferably, at least ten.

Referring to step 404, the received CNTs are then coated with $M1_xO_y$ and the coated carbon nanotubes are modified with $M2_mO_n$ in step 406. The coated and modified CNTs are then calcined in step 408. The coating 404, modifying 406, and calcination 408 steps can be performed in several ways, as discussed in greater detail below.

For example, an aqueous solution of CNTs and a metallic compound, such as a cerium-containing compound, such as, for example, cerium nitrate ($Ce(NO_3)_3$), can be stirred homogeneously at a temperature between 20 and 70° C. or, preferably, between 35 and 45° C. The resultant slurry can be dried and calcined at a temperature between 500 and 800° C. Then, the calcined solid can be mixed homogeneously with an aqueous solution having a silicon-containing and/or tungsten-containing compound, such as, for example, sodium metasilicate ($Na_2SiO_3$). The mixture can be stirred at a temperature of between 20 and 70° C. or, preferably, between 35 and 45° C. for 4 to 8 hours or, preferably, 6 to 8 hours. The resultant mixture can simultaneously be adjusted to a pH of 6 to 8 by additionally mixing a conventional alkaline or acidic aqueous solution, such as, for example, hydrochloric acid (HCl), nitric acid ($HNO_3$), sodium hydroxide (NaOH), and/or potassium hydroxide (KOH). Then, the resultant aqueous slurry can be heated to a temperature between 30 and 90° C. or, preferably, 50 and 70° C., until all of the water in the aqueous slurry has completely evaporated leaving a solid product. The remaining solid product can be washed with distilled water to separate any impurities, dried, and calcined at a temperature of 500 and 800° C., leaving the CNT catalyst.

In another example, an aqueous solution of CNTs, a metallic compound, such as a cerium-containing compound, such as, for example, cerium nitrate ($Ce(NO_3)_3$), and a silicon-containing and/or tungsten-containing compound, such as, for example, sodium metasilicate ($Na_2SiO_3$), can be stirred homogeneously. The mixture can be stirred at a temperature of between 20 and 70° C. or, preferably, between 35 and 45° C. for 4 to 8 hours or, preferably, 6 to 8 hours. The mixture can simultaneously be adjusted to a pH of 6 to 8 by additionally mixing a conventional alkaline or acidic aqueous solution, such as, for example, hydrochloric acid (HCl), nitric acid ($HNO_3$), sodium hydroxide (NaOH), and/or potassium hydroxide (KOH). Then, the resultant aqueous slurry can be heated to a temperature between 30 and 90° C. or, preferably, 50 and 70° C. until all of the water in the aqueous slurry has completely evaporated leaving a solid product. The remaining solid product can be washed with distilled water to separate any impurities, dried, and calcined at a temperature of 500 and 800° C., leaving the CNT catalyst.

In yet another example, an aqueous solution of CNTs and a silicon-containing and/or tungsten-containing compound, such as, for example, sodium metasilicate ($Na_2SiO_3$), can be stirred homogeneously at a temperature between 20 and 70° C. or, preferably, between 35 and 45° C. for 4 to 8 hours or, preferably, 6 to 8 hours. The resultant mixture can simultaneously be adjusted to a pH of 6 to 8 by additionally mixing a conventional alkaline or acidic aqueous solution, such as, for example, hydrochloric acid (HCl), nitric acid ($HNO_3$), sodium hydroxide (NaOH), and/or potassium hydroxide (KOH). Then, the resultant aqueous slurry can be heated to a temperature between 30 and 90° C. or, preferably, 50 and 70° C. until all of the water in the aqueous slurry has completely evaporated leaving a solid product. The remaining solid product can be washed with distilled water to separate any impurities, dried, and calcined at a temperature of 500 and 800° C. The calcined solid can be mixed homogeneously with an aqueous solution including a metallic compound, such as a cerium-containing compound, such as, for example, cerium nitrate ($Ce(NO_3)_3$) at a temperature between 20 and 70° C. or, preferably, between 35 and 45° C. The resultant slurry can be dried and the dried solid can be calcined at a temperature of 500 and 800° C., leaving the CNT catalyst.

The calcination step 408 in the synthesis of the CNT catalyst can include, for example, heating the CNT catalyst to about 350° C. at a rate of 2 to 10° C./min or, preferably, at a rate of 2 to 4° C./min, in the presence of air and/or a mixture of oxygen gas ($O_2$) with an inert gas, such as, for example, nitrogen gas ($N_2$) and/or helium (He). The temperature can then be increased to 500 to 800° C. at a rate of 2 to 10° C./min or, preferably, at a rate of 2 to 4° C./min, in the presence of an inert gas, such as, for example, nitrogen gas ($N_2$) and/or helium (He). The CNT catalyst can then be cooled to, for example, 60° C. to allow for slight evaporation in the presence of an inert gas, such as, for example, nitrogen gas ($N_2$) and/or helium (He).

Catalyst Synthesis Example 1

A) Preparation of the CNT Catalyst

Initially, 1.45 g of sodium metasilicate ($Na_2SiO_3$) including 10% silicon dioxide ($SiO_2$) by weight was dissolved in 35 g water. Two grams of multi-walled CNTs, having a diameter between 10 and 20 nm and a length between 5 to 15 μm, was mixed and stirred homogeneously with the mixture at 40° C. for 7 hours. Simultaneously, cerium nitrate ($Ce(NO_3)_3$) was also added to the solution at various dry weight percentages (hereinafter "wt") of cerium oxide ($CeO_2$). The weight percentages of cerium oxide ($CeO_2$) included in different synthesis experiments were, for example, 2%, 6%, 10%, and 15%. Hydrochloric acid was also added to the mixture until the pH of the mixture was adjusted to about 7. After complete dispersion of the CNTs, the mixture was heated to 80° C. and the water in the mixture was slowly evaporated. The resultant solid product was washed with distilled water and dried for 8 to 10 hours at, for example, 60° C. to allow for slight evaporation. The dried solid product was then calcined at 700° C. for 5 hours, according to the above-mentioned procedure, to obtain the CNT catalyst.

B) Olefin Production Operating Conditions

The thermal cracking reactor 210 was operated at a reaction temperature of 680° C., with a hydrocarbon feedstock-to-steam ratio of 2:1, with 2 grams of catalyst, a hydrocarbon feedstock residence time of 0.5 seconds, and a run time of about 1 hour, i.e., olefin production was measured after 1 hour of running the same catalyst in the reactor.

C) Olefin Production Yield

TABLE 1

| Catalyst | CNT(2% wt $Ce_2O_3$)(10% wt $SiO_2$) | CNT(6% wt $Ce_2O_3$)(10% wt $SiO_2$) | CNT(10% wt $Ce_2O_3$)(10% wt $SiO_2$) | CNT(15% wt $Ce_2O_3$) (10% wt $SiO_2$) |
|---|---|---|---|---|
| Yield of Ethylene (wt) | 18.15% | 20.33% | 21.75% | 21.34% |
| Yield of Propylene (wt) | 17.68% | 18.12% | 19.08% | 19.89% |
| Yield of Olefins (wt) | 39.92% | 42.28% | 44.54% | 44.33% |

As illustrated by TABLE 1, use of the CNT catalyst coated with 10% wt $SiO_2$ and modified with 10% wt $Ce_2O_3$ provided the maximum yield of olefins at 44.54%. The same CNT catalyst also provided the highest yield of ethylene at 21.75% and the second highest yield of propylene at 19.08%. Higher and lower weight percentages of $Ce_2O_3$ lowered the total yield of olefins.

Catalyst Synthesis Example 2

A) Preparation of the CNT Catalyst

Initially, sodium metasilicate ($Na_2SiO_3$) including various weight percentages of silicon dioxide ($SiO_2$) by weight was dissolved in 35 g water. The weight percentages of silicon dioxide ($SiO_2$) included in different synthesis experiments were, for example, 5%, 10%, 15%, and 20%. Two grams of multi-walled CNTs, having a diameter between 10 and 20 nm and a length between 5 to 15 μm, was mixed and stirred homogeneously with the mixture at 40° C. for 7 hours. Simultaneously, cerium nitrate ($Ce(NO_3)_3$) including 10% cerium oxide ($CeO_2$) was also added to the solution. 10% cerium oxide ($CeO_2$) was selected as it provided the highest product yield of olefins, as shown in CATALYST SYNTHESIS EXAMPLE 2 above. Hydrochloric acid was also added to the mixture until the pH of the mixture was adjusted to about 7. After complete dispersion of the CNTs, the mixture was heated to 80° C. and the water in the mixture was slowly evaporated. The resultant solid product was washed with distilled water and dried for 8 to 10 hours at, for example, 60° C. to allow for slight evaporation. The dried solid product was then calcined at 700° C. for 5 hours, according to the above-mentioned procedure, to obtain the CNT catalyst.

B) Olefin Production Operating Conditions

The thermal cracking reactor 210 was operated at a reaction temperature of 680° C., with a hydrocarbon feedstock-to-steam ratio of 2:1, with 2 grams of catalyst, a hydrocarbon feedstock residence time of 0.5 seconds, and a run time of about 1 hour, i.e., olefin production was measured after 1 hour of running the same catalyst in the reactor.

C) Olefin Production Yield

TABLE 2

| Catalyst | CNT(10% wt $Ce_2O_3$)(5% wt $SiO_2$) | CNT(10% wt $Ce_2O_3$)(10% wt $SiO_2$) | CNT(10% wt $Ce_2O_3$)(15% wt $SiO_2$) | CNT(10% wt $Ce_2O_3$) (20% wt $SiO_2$) |
|---|---|---|---|---|
| Yield of Ethylene (wt) | 22.56% | 21.75% | 21.03% | 20.76% |
| Yield of Propylene (wt) | 17.39% | 19.08% | 19.25% | 18.97% |
| Yield of Olefins (wt) | 42.37% | 44.54% | 44.06% | 43.35% |

As illustrated by TABLE 2, use of the CNT catalyst coated with 10% wt $SiO_2$ and modified with 10% wt $Ce_2O_3$ again provided the maximum yield of olefins at 44.54%. The same CNT catalyst also provided the second highest yield of ethylene at 21.75% and the second highest yield of propylene at 19.08%. Higher and lower weight percentages of $SiO_2$ lowered the total yield of olefins.

Comparative Example

A) Olefin Production Yield using CNT(10% wt $Ce_2O_3$)(10% wt $SiO_2$) Catalyst

The thermal cracking reactor 210 was operated at a reaction temperature of 680° C., with a hydrocarbon feedstock-to-steam ratio of 2:1, with 2 grams of catalyst, and a hydrocarbon feedstock residence time of 0.5 seconds. However, in this example, olefin production was measured after 48 hours of running the same catalyst in the reactor, i.e., a run time of 48 hours, in order to test the CNT(10% wt $Ce_2O_3$)(10% wt $SiO_2$) catalyst stability.

B) Olefin Production Yield using No Catalyst

The thermal cracking reactor 210 was operated at a reaction temperature of 680° C., with a hydrocarbon feedstock-to-steam ratio of 2:1, a hydrocarbon feedstock residence time of 0.5 seconds, and a run time of about 1 hour, without the use of a catalyst, in order to measure the improvement in production yield as a result of the CNT(10% wt $Ce_2O_3$)(10% wt $SiO_2$) catalyst.

C) Olefin Production Yield using HZSM-5 Zeolite (10% wt $Ce_2O_3$) Catalyst a) Preparation of HZSM-5 Zeolite (10% wt $Ce_2O_3$) Catalyst Initially, cerium nitrate ($Ce(NO_3)_3$) including 10% cerium oxide ($CeO_2$) was dissolved in 1 gram of water. Next, 2 grams of dry HZSM-5 molecular sieve ($SiO_2/Al_2O_3$=28) was mixed into the solution. The resultant solution was dried at 60° C. for between 8 to 10 hours and calcined at 700° C. for 5 hours.

b) Olefin Production Yield using HZSM-5 Zeolite (10% wt $Ce_2O_3$) Catalyst

The thermal cracking reactor 210 was operated at a reaction temperature of 680° C., with a hydrocarbon feedstock-to-steam ratio of 2:1, with 2 grams of the HZSM-5 Zeolite (10% wt $Ce_2O_3$) catalyst, a hydrocarbon feedstock residence time of 0.5 seconds, and a run time of about 1 hour.

D) Olefin Production Yield using HZSM-5 Zeolite (10% wt $Ce_2O_3$) Catalyst

The thermal cracking reactor 210 was operated at a reaction temperature of 680° C., with a hydrocarbon feedstock-to-steam ratio of 2:1, with 2 grams of the HZSM-5 Zeolite (10% wt $Ce_2O_3$) catalyst, and a hydrocarbon feedstock residence time of 0.5 seconds. However, in this example, olefin production was measured after 48 hours of running the same catalyst in the reactor, i.e., a run time of 48 hours, in order to test the HZSM-5 Zeolite (10% wt $Ce_2O_3$) catalyst stability.

TABLE 3

| Catalyst | CNT(10% wt $Ce_2O_3$)(10% wt $SiO_2$) after 48 hour run time | No Catalyst | HZSM-5 Zeolite (10% wt $Ce_2O_3$) | HZSM-5 Zeolite (10% wt $Ce_2O_3$) after 48 hour run time |
|---|---|---|---|---|
| Yield of Ethylene (wt) | 20.18% | 14.67% | 17.99% | 15.13% |
| Yield of Propylene (wt) | 17.94% | 11.83% | 20.11% | 12.43% |
| Yield of Olefins (wt) | 40.78% | 28.14% | 41.13% | 29.45% |

As illustrated by TABLE 3, the total yield of olefins when the run time of the CNT(10% wt $Ce_2O_3$)(10% wt $SiO_2$) catalyst is increased to 48 hours is 40.78%. As discussed above in connection with TABLES 1 and 2, the total yield of olefins when the run time of the CNT(10% wt $Ce_2O_3$)(10% wt $SiO_2$) catalyst is about 1 hour is 44.54%. As such, the total production yield of olefins was reduced by only 3.76%, showing that the CNT(10% wt $Ce_2O_3$)(10% wt $SiO_2$) catalyst exhibits high stability.

The total yield of olefins without the use of a catalyst was 28.14%, which is 16.40% lower than the total yield of olefins using the CNT(10% wt $Ce_2O_3$)(10% wt $SiO_2$) catalyst. As such, the use of the CNT(10% wt $Ce_2O_3$)(10% wt $SiO_2$) catalyst results in a significant olefin yield increase relative to prior systems that did not employ a catalyst.

The total yield of olefins using the HZSM-5 zeolite (10% wt $Ce_2O_3$) catalyst was 41.13%, which is 3.41% lower than the total yield of olefins using the CNT(10% wt $Ce_2O_3$)(10% wt $SiO_2$) catalyst. As such, the use of the CNT(10% wt $Ce_2O_3$)(10% wt $SiO_2$) catalyst results in an olefin yield increase relative to prior catalysts. In addition, the yield of ethylene using the CNT(10% wt $Ce_2O_3$)(10% wt $SiO_2$) catalyst was higher than that of the HZSM-5 zeolite (10% wt $Ce_2O_3$) catalyst, whereas the yield of propylene was slightly lower.

In addition, the total yield of olefins when the run time of the HZSM-5 Zeolite (10% wt $Ce_2O_3$) catalyst is increased to 48 hours is 29.45%, resulting in an 11.68% drop in olefin yield relative to a run time of about 1 hour. The 11.68% drop associated with the HZSM-5 Zeolite (10% wt $Ce_2O_3$) catalyst is significantly greater than the 3.76% drop associated with the CNT(10% wt $Ce_2O_3$)(10% wt $SiO_2$) catalyst. As such, the CNT(10% wt $Ce_2O_3$)(10% wt $SiO_2$) catalyst exhibits greater catalytic stability that previous catalysts.

It is to be understood the implementations are not limited to the particular devices or apparatus described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise.

Accordingly, other implementations are within the scope of this application.

What is claimed is:

1. A method for producing olefins using a carbon nanotube catalyst, the method comprising:

receiving hydrocarbon feedstock;

mixing the hydrocarbon feedstock, a carbon nanotube catalyst, and steam in a thermal cracking reactor;

heating the mixture of the hydrocarbon feedstock, the carbon nanotube catalyst, and the steam in the thermal cracking reactor to a particular temperature; and separating olefins from the mixture of the hydrocarbon feedstock, the carbon nanotube catalyst, and the steam, wherein the carbon nanotube catalyst comprises carbon nanotubes coated with $M1_xO_y$ and modified with $M2_mO_n$, M1 is either the element silicon or tungsten, x is an integer that represents the oxidation number of M1, y is an integer that represents the number of oxygen atoms required by the oxidation number of M1, M2 is a metallic element, m is an integer that represents the oxidation number of M2, and n is an integer that represents the number of oxygen atoms required by the oxidation number of M2.

2. The method of claim 1, wherein the metallic element M2 is an element selected from the group consisting of calcium, strontium, magnesium, barium, iron, nickel, cobalt, manganese, molybdenum, copper, chromium, gallium, bismuth, aluminum, lanthanum, cerium, and tin.

3. The method of claim 1, wherein $M1_xO_y$ is $SiO_2$.

4. The method of claim 3, wherein $M2_mO_n$ is $CeO_2$.

5. The method of claim 4, wherein the carbon nanotube catalyst comprises 10%, by weight, $CeO_2$ and 10%, by weight, $SiO_2$.

6. The method of claim 1, wherein the carbon nanotube catalyst comprises 65% to 95.5%, by weight, carbon nanotubes, 3% to 20%, by weight, $M1_xO_y$, and 1.5% to 15%, by weight, $M2_mO_n$.

7. The method of claim 1, wherein receiving the hydrocarbon feedstock comprises receiving a petroleum hydrocarbon feedstock.

8. The method of claim 1, wherein receiving the hydrocarbon feedstock comprises receiving a full-range naphtha consisting of 44.28% n-paraffin, 39.31% iso-paraffin, 12.68% naphthene, and 3.73% aromatics.

9. The method of claim 1, further comprising receiving water.

10. The method of claim 9, further comprising:

vaporizing the hydrocarbon feedstock in a first vaporizer to produce vaporized hydrocarbon feedstock; and vaporizing the water in a second vaporizer to produce steam; and mixing the vaporized hydrocarbon feedstock and the steam.

11. The method of claim 1, wherein heating the mixture of the hydrocarbon feedstock, the carbon nanotube catalyst, and the steam in the thermal cracking reactor to the particular temperature comprises heating the mixture of the hydrocarbon feedstock, the carbon nanotube catalyst, and the steam in the thermal cracking reactor to a temperature between 600 and 680° C.

12. The method of claim 1, wherein heating the mixture of the hydrocarbon feedstock, the carbon nanotube catalyst, and the steam in the thermal cracking reactor to the particular temperature comprises heating the mixture of the hydrocarbon feedstock, the carbon nanotube catalyst, and the steam in the thermal cracking reactor to the particular temperature for between 0.5 and 100 seconds.

13. The method of claim 1, wherein heating the mixture of the hydrocarbon feedstock, the carbon nanotube catalyst, and the steam in the thermal cracking reactor to the particular temperature comprises heating the mixture of the hydrocarbon feedstock, the carbon nanotube catalyst, and the steam in a fixed-bed reactor to the particular temperature.

14. The method of claim 13, wherein the space velocity of the fixed-bed reactor is between 0.5 and 40 $hr^{-1}$.

15. The method of claim 1, wherein heating the mixture of the hydrocarbon feedstock, the carbon nanotube catalyst, and the steam in the thermal cracking reactor to the particular temperature comprises heating the mixture of the hydrocarbon feedstock, the carbon nanotube catalyst, and the steam in a fluidized-bed reactor to the particular temperature.

16. The method of claim 1, wherein the range of the weight ratio of the hydrocarbon feedstock to the carbon nanotube catalyst is between 5:1 and 20:1 in the thermal cracking reactor.

17. The method of claim 1, wherein the range of the weight ratio of the hydrocarbon feedstock to the steam is between 0.1:1 and 2:1 in the thermal cracking reactor.

18. The method of claim 1, wherein separating the olefins from the mixture of the hydrocarbon feedstock, the carbon nanotube catalyst, and the steam comprises separating ethylene and/or propylene from the mixture of the hydrocarbon feedstock, the carbon nanotube catalyst, and the steam.

19. The method of claim 1, wherein the carbon nanotubes of the carbon nanotube catalyst have a length-to-width aspect ratio of equal to or greater than ten.

20. The method of claim 1, wherein the total yield of olefins is at least 44%.

* * * * *